US007064662B2

(12) United States Patent
Goggin

(10) Patent No.: US 7,064,662 B2
(45) Date of Patent: Jun. 20, 2006

(54) MASTER SIGNAL TRANSMITTER WITH ALLIED SERVANT RECEIVER TO RECEIVE A DIRECTED SIGNAL FROM THE TRANSMITTER

(75) Inventor: Christopher M. Goggin, Wilmington, NC (US)

(73) Assignee: Oils Wells, Inc., Bayshore, NY (US)

( * ) Notice: Subject to any disclaimer, the term of this patent is extended or adjusted under 35 U.S.C. 154(b) by 236 days.

(21) Appl. No.: 10/317,919

(22) Filed: Dec. 11, 2002

(65) Prior Publication Data

US 2004/0113776 A1 Jun. 17, 2004

(51) Int. Cl.
*G08B 1/08* (2006.01)

(52) U.S. Cl. ..... 340/539.32; 340/693.3; 455/334; 367/135

(58) Field of Classification Search ..... 340/539.32, 340/539.3, 693.3, 572.7, 572.1, 10.33, 10.34, 340/7.32–7.37, 571; 455/41.2; 343/866, 343/844, 908
See application file for complete search history.

(56) References Cited

U.S. PATENT DOCUMENTS

| | | | | | |
|---|---|---|---|---|---|
| 4,101,873 | A | | 7/1978 | Anderson et al. | 340/539 |
| 4,476,469 | A | | 10/1984 | Lander | 340/825.49 |
| 4,507,653 | A | * | 3/1985 | Bayer | 340/539.32 |
| 4,955,038 | A | * | 9/1990 | Lee et al. | 375/256 |
| 5,204,657 | A | | 4/1993 | Prosser et al. | 340/568 |
| 5,638,050 | A | | 6/1997 | Sacca et al. | 340/571 |
| 5,673,023 | A | | 9/1997 | Smith | 340/571 |
| 5,677,673 | A | | 10/1997 | Kipnis | 340/539 |
| 5,680,105 | A | | 10/1997 | Hedrick | 340/571 |
| 5,686,887 | A | * | 11/1997 | Chen et al. | 340/539.19 |
| 5,686,891 | A | | 11/1997 | Sacca et al. | 340/571 |
| 5,939,981 | A | | 8/1999 | Renney | 340/539 |
| 6,011,466 | A | | 1/2000 | Goldman | 340/539 |
| 6,012,029 | A | * | 1/2000 | Cirino et al. | 704/275 |
| 6,025,783 | A | | 2/2000 | Steffens, Jr. | 340/644 |
| 6,133,832 | A | | 10/2000 | Winder et al. | 340/572.1 |

(Continued)

OTHER PUBLICATIONS

International Search Report dated Jun. 22, 2005.

*Primary Examiner*—Benjamin C. Lee

(57) ABSTRACT

A device for locating an object, which includes a master transmitter with at least one servant receiver. A signal from the master transmitter unit activates the servant receiver unit, which then turns itself on. The servant receiver unit has both sound and light output to attract the attention of a user. The servant receiver unit is placed on an object like luggage, a remote control, a personal data assistant, or the like. When the user has misplaced the valuable object, the master transmitter unit is used to activate the servant unit whose light and sound makes it possible to locate the lost object. Because the servant receiver unit is not turned on until it receives the signal from the master transmitter unit, it draws negligible current from a battery. This means that batteries need not be replaced in the servant receiver unit whose effective life will be close to the shelf life of the batteries. When the batteries finally stop working, the servant receiver unit is discarded and a replacement servant receiver unit is obtained. The master transmitter unit may use a single radio frequency signal, dual radio frequency signal, an amplitude modulated radio frequency signals, an ultrasonic signal, or an infrared signal. Appropriate choice of materials, along with appropriate design, allows the master transmitter unit and servant receiver unit, when using radio frequency, to comply with FCC rules while still being effective to distances of 50 feet.

26 Claims, 9 Drawing Sheets

U.S. PATENT DOCUMENTS 6,147,602 A 11/2000 Bender ..... 340/568.1
6,366,202 B1 4/2002 Rosenthal ..... 340/539
6,674,364 B1 * 1/2004 Holbrook et al. ..... 340/568.1
6,774,787 B1 * 8/2004 Melbourne ..... 340/539.1

* cited by examiner

MASTER SIGNAL TRANSMITTER WITH ALLIED SERVANT RECEIVER TO RECEIVE A DIRECTED SIGNAL FROM THE TRANSMITTER

BACKGROUND OF THE INVENTION

1. Field of the Invention

This invention relates generally to a master transmitter and servant receiver system with a normally dormant servant receiver. When the servant unit receives a signal from the master transmitter, it will generate a sound or light or both, making it easier for the operator of the master unit to find a servant unit. The servant units are normally off and require no maintenance. The master signal unit may use Radio Frequency (RF), Infrared (IR), or Ultrasonic (Acoustic) or a combination thereof.

2. Description of Related Art

A variety of tag devices have been proposed to locate lost or misplaced objects. Prior art servant receivers are on or cycle on and off through a sleep mode. This results in a constant current drain on the battery power supply. Here, a particular type of switch technology is used in the servant receiver. The signal created by the master or handheld transmitter activates a switch to turn on the power in this servant receiver. Therefore, until a signal is sent by the master transmitter and received by the servant receiver, the servant receiver is off with no drain in the battery. The current technology for tag devices propose replacing the battery every few months in the servant receiver. In this technology, the servant receiver battery would only be on when required to activate the sound and or light, hence, extending the battery life of the receiver to essentially the shelf life of the battery.

There are a large number of patents that seek to solve the general problem solved by this invention, which is helping the owner of the invention locate a particular item to which a tag unit is attached and which responds to a signal from the master unit. None of these address the particular problem addressed here. Some use coded signals (Bender U.S. Pat. No. 6,147,602). Renney U.S. Pat. No. 5,939,981 proposes using multiple sensors which are sensitive to the proximity of the master unit to cause sensors to issue a louder tone. Sacca et al. U.S. Pat. No. 5,638,050 recognizes that battery drain is a problem and proposes a receiver cycling in a given time frame. The activating signal is timed to be longer than the period of time the servant receiver is off, hence, the servant receiver will always be on for at least a portion of the activation signal duration, hence, will respond. Because the servant receiver is cycled on and off, it preserves battery life. The patent is relevant in that it recognizes there is a battery problem and attempts to solve it but does so in an entirely different way from the current invention. The Sacca patent U.S. Pat. No. 5,686,891 is similar to the above described '050 patent. The Rosenthal patent U.S. Pat. No. 6,366,202 proposes an acoustic signal with a piezoelectric transducer to receive the signal. An ultrasonic signal from a transmitter is receiver by a resonator which amplifies it in intensity relative to the signal sound wave. Avoiding false triggering is done by use of a coded sequence from the transmitter. This includes a tone followed by a quiet period, a second tone followed by a second quiet period, followed by a third tone, quiet period, and a fourth and final tone. The Steffen patent U.S. Pat. No. 6,025,783 is an entirely different area but has technology of interest. This proposes a wireless system to detect whether a switch is open or not. For example, it could be used in cars to determine if doors are open or not. A tag circuit is responsive to the transmission signal and is powered by the transmitted signal.

SUMMARY OF THE INVENTION

The current invention is a receiver/transmitter system used to locate lost items. The servant receiver is maintenance free for a life span of the battery, for example up to 8 years for a lithium ion battery. The servant receiver is approximately the size of a U.S. Quarter in diameter (1") and approximately the thickness of three quarters stacked together (0.21). It can be attached to various objects by bonding or adhering to the bottom surface, a key ring attachment and a clip feature for paper or documents. The servant receiver is a completely sealed product and weather proof. When the servant receiver is activated by the transmitter, it emits a 6 KHz pitched sound along with the simultaneous illumination of two LED lights occur making it easy to detect and locate. The servant receiver may be up to 50 feet away from the transmitter and still be activated by the transmitter signal. There is no amplifier in the servant receiver and a unique antenna circuit generates enough current to activate the servant receiver. An antenna circuit in combination with a low current drain voltage comparator is used to activate the sound and LED light circuit. The voltage comparator may be triggered using three different technologies.

First, a radio frequency signal activates the voltage comparator. Only when the radio signal is sent by the transmitter will the servant receiver be activated. In the preferred embodiment the antenna circuit uses no amplification and thus no current drain until the servant receiver is triggered. The comparator uses negligible power.

The second method uses ultrasonic transducers tuned to 40 KHz at the master transmitter and servant receiver. When activated, the master transmitter emits a steady ultrasonic pulse at 40 KHz and is received by piezo transducer in the servant receiver. The ultrasonic signal is transmitted at 15 degree cone angle; any servant receiver within this cone will be triggered. The cone effect will provide directional information; simply sweeping the master transmitter right or left will provide a direction to the lost object. The voltage generated at the piezo transducer requires no amplification to trigger the servant receiver and thus no current drain until the servant receiver is triggered.

The third signal generation is with an infrared LED and compatible IR detector at the receiver. Due to the range requirements and the sensitivity of the voltage comparator circuit no amplification is required and as described above presents no current drain until the servant receiver is triggered.

Both the master transmitter with the servant receivers are ordinarily off. On the master transmitter a thumb button is depressed, which sends out a signal (RF, Ultrasonic, or IR), to the antenna circuit in the servant receiver which powers up the servant receiver. A low-voltage comparator circuit is situated behind the RF, Ultrasonic, or IR antenna detectors for each application. The comparator detector circuit will trigger either an "AND" gate or transistor. The comparator acts as an amplifier and opens the buzzer and light circuit in the servant receiver. A battery is in the servant receiver and operates only when the antenna/diode detector circuit is energized by a signal received from the master transmitter. The battery powers the buzzer generator and light generator on the servant receiver. If a 3-volt battery is used, then a battery is typically good for 250 milliamp hours. The buzzer generator and light generator draw about 2.2 milliamps.

Ordinarily, very little time will be required between the time the master transmitter is activated and the servant receiver begins to emit a sound and light for the item to which the servant receiver is attached to be found. Consequently, the 3-volt battery is good for approximately 3 years of use or 8 years of waiting time if not triggered. The shelf life of most lithium batteries is 10 years. After the life of the battery, the servant receiver is discarded without the need of replacing the batteries. The bottom of the servant receiver of the current invention is a non-intrusive battleship gray color. The LED light rings will display a bright bluish-green color light when the received is pulsed. The top of the servant receiver of the current invention will be an iridescent lime green color.

The servant receiver of the current invention can attach to items in four different ways. First, it has an included peel & stick adhesive pad, which is removable, that fits inside the indention of the key ring. This allows for a removable "sticker" option that does not increase the thickness of the servant receiver. Second, the servant receiver of the current invention can be attached using a permanent adhesive. Thirdly, it can be attached by using the fold out key chain located on the bottom side of the receiver. Lastly, it can be attached with a magnetic paper clip. The same rings that swivel out into the key chain act as a magnetized clip that pinches.

DETAILED DESCRIPTION OF THE DRAWINGS

Figure 1:
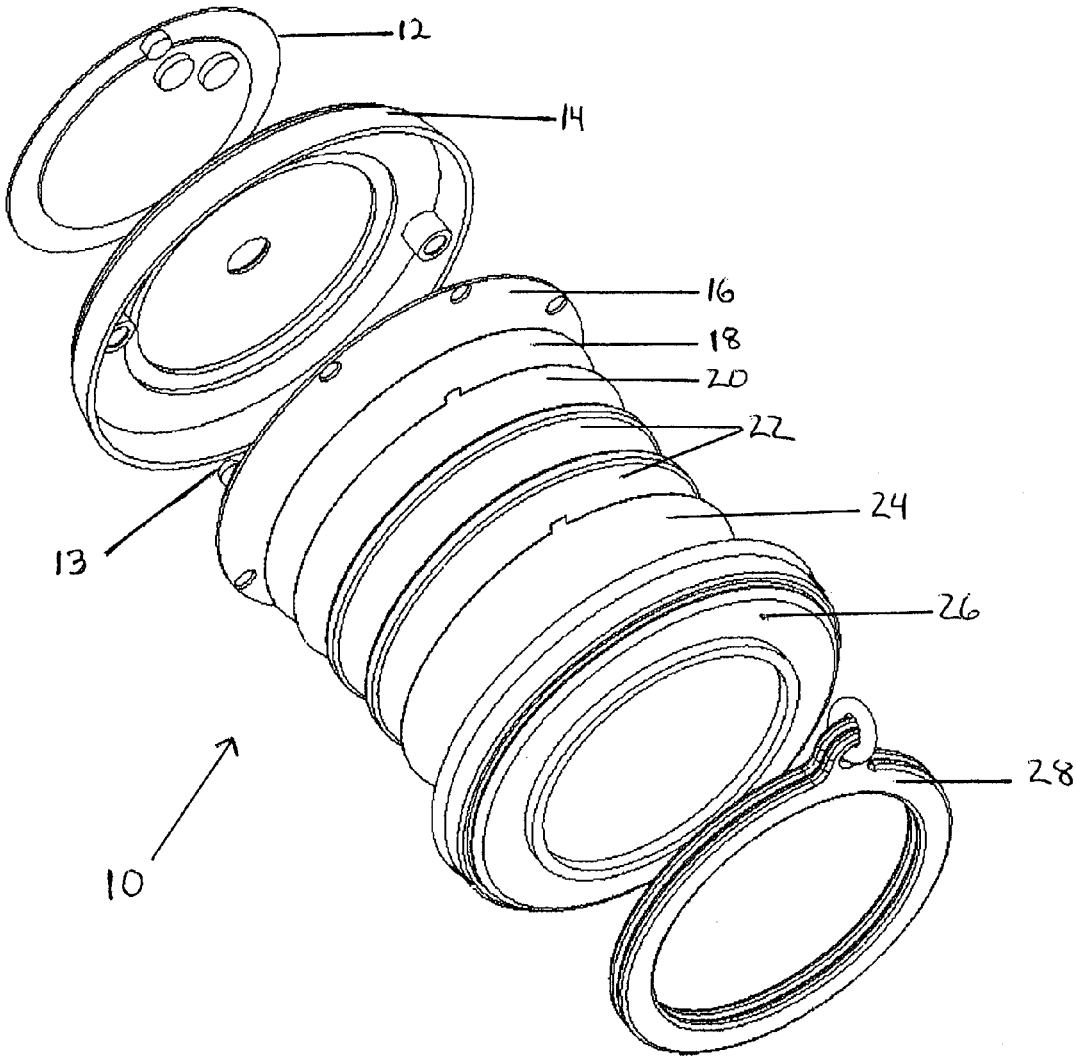
FIG. 1 is an exploded view of the servant receiver of the current invention.

FIG. 1 shows an exploded perspective view from the clip assembly (28) side of the servant receiver (10). A piezo buzzer sound unit (12) is fitted into the top cover (14). The top cover (14) connects to the lower case (26) when assembled with the remaining pieces shown in exploded view contained therein. Immediately below the cover (14) is the PC board (16). Below the PC board (16) is an insulator (18). Below that is the cathode (20). Two 3-volt batteries (22) will be placed immediately below the cathode (20) and immediately above the anode (24). The anode (24) fits into the lower case (26) so that when the top (14) is connected to the lower case (26) the PC board (16), insulator (18), cathode (20), batteries (22), and anode (24) will all be operatively connected for operation of the servant receiver (10).

Figure 2:
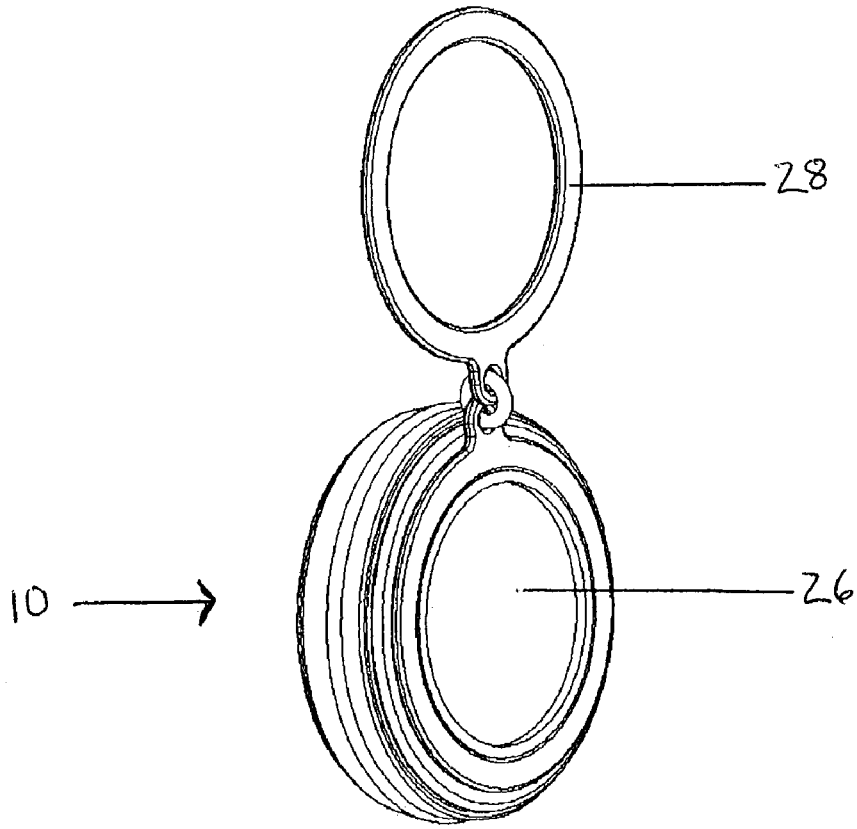
FIG. 2 is an assembled view of the servant receiver from the bottom with the key loop unfolded.
Figure 2A:
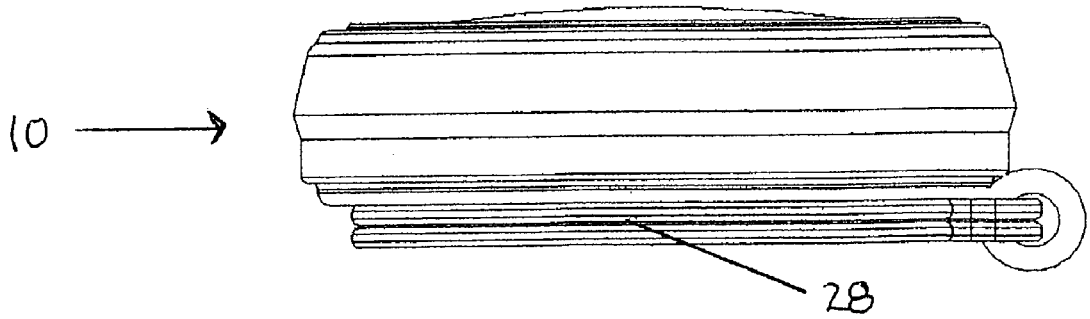
FIG. 2A is an assembled view of the servant receiver seen from the side with the key loop folded.
Figure 3:
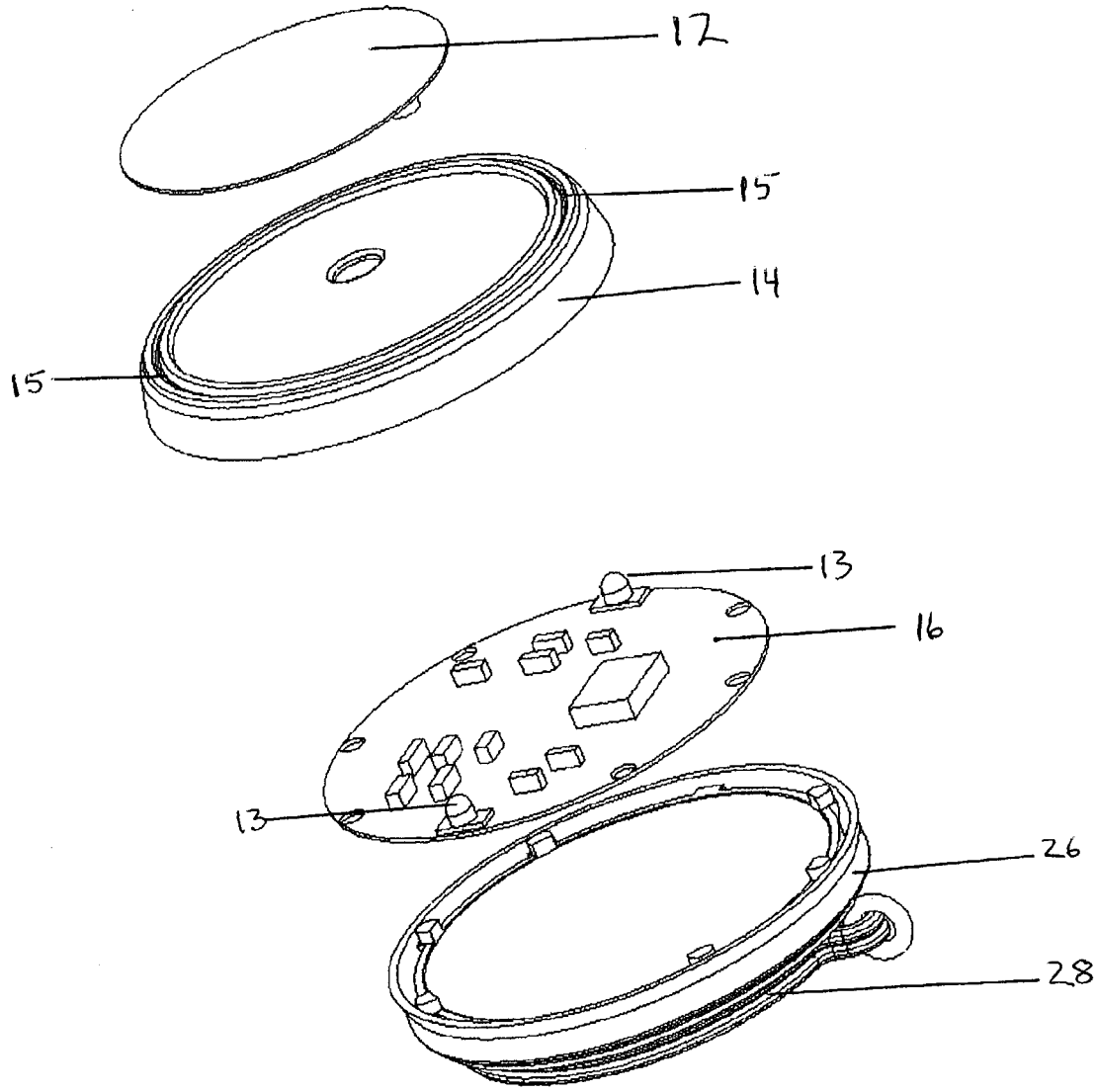
FIG. 3 is a partial exploded view of the servant receiver to show the sound and light units.

FIG. 2 shows the servant receiver (10) from a bottom view with the clip assembly (28) unfolded. A peel-and-stick adhesive pad (not shown) may be affixed within the clip assembly (28) and attached directly to a side of the lower case (26). This peel-and-stick adhesive pad (not shown) does not increase the thickness of the servant receiver (10). The clip assembly (28) allows the servant receiver (10) to be directly affixed to an item as required. The clip assembly (28) may be magnetized so that the two jaws of the clip assembly (28) may act as a pinching assembly to hold the servant receiver (10) in place on an item. FIG. 2A shows the servant receiver (10) from the side view with the clip assembly (28) folded together. In this view, the clip assembly (28) can be assumed to be magnetized in that the two opposing jaws of the clip assembly (28) are held together by magnetic force. The servant receiver (10) will ordinarily be approximately one inch in diameter and approximately one-fifth of an inch in thickness. FIG. 3 is a partially exploded view of the servant unit (10). Here, on the circumference of the PC board (16) are two light emitting diodes (LED), which form the light unit (13). These two LED's fit into receiving cylinders seen on the bottom of the top cover (14) in FIG. 1. Around the circumference of the top cover (14) is a translucent ring (15) so that when the light source (13) (here, LED's) are activated, the entire translucent ring (15) will glow with the light generated by the light source (13). The sound output (12) (here, a piezo buzzer) fits onto the top cover (14) inside the translucent ring (15).

Figure 4:
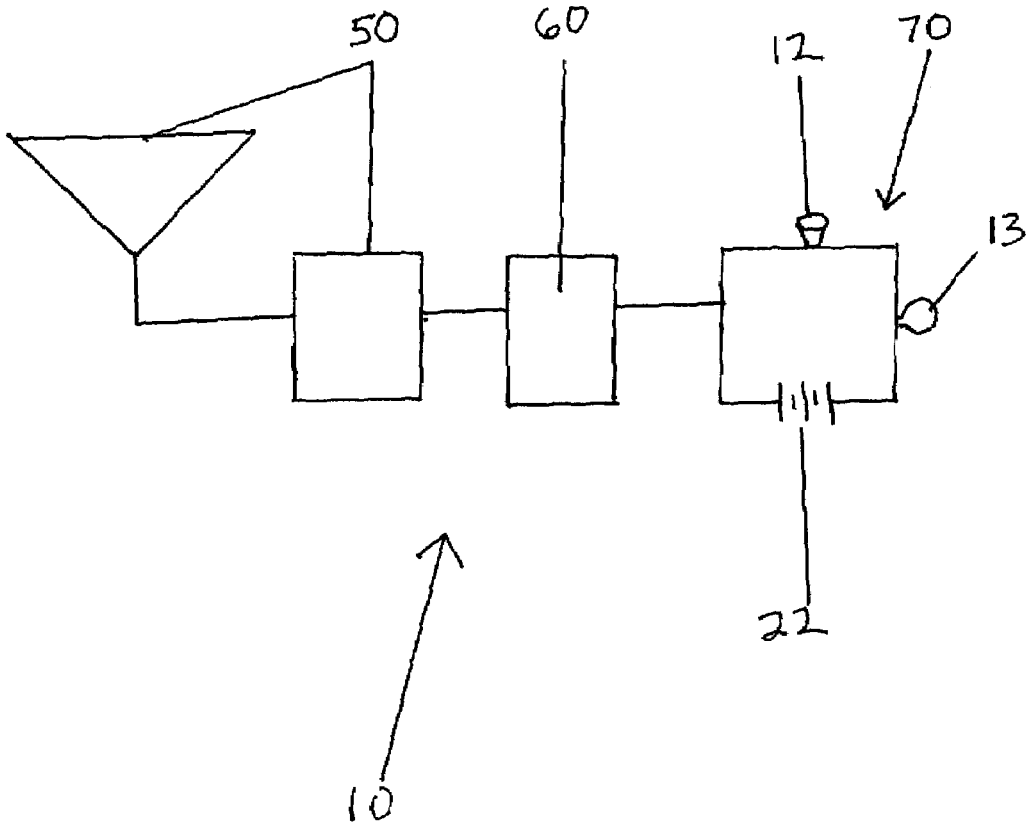
FIG. 4 is a simplified diagram of the servant receiver.

FIG. 4 shows a simplified block diagram of the servant receiver (10) for all embodiments, radio frequency, infrared, or ultrasonic. Broadly speaking, the servant receiver (10) consists of three separate operating components. First, is a signal receiver unit (50). This signal receiver unit (50) can be activated by a number of technologies as will be discussed in following paragraphs. Among these are dual radio frequencies, a single radio frequency, a sonic frequency, or an infrared signal. The purpose of the signal receiver unit (50) is to activate the voltage comparator (60). Neither the signal receiver unit (50) nor the voltage comparator (60) will require any significant current to operate and will be active in the stand-by mode at all times without draining the battery (22). The voltage comparator (60) may use a negligible amount of current in the stand-by mode. As will be explained later, one particular voltage comparator manufactured by Texas Instruments uses 1.2 microamps in the stand-by mode. Under current technology that use chemical reaction for 3-volt batteries, the shelf life of the battery, even if no drain is present, is limited by the viability of the chemical reactions that produce current. Typically, the shelf life of most 3-volt batteries is no more than 10 years. These batteries will, if drained at a rate of 1.2 microamps, still have sufficient charge to operate the output unit (70) even at the end of the normal shelf life for a 3-volt battery. That is to say, the battery will quit working because of the chemical reactions that provide the power have stopped working, not because the battery has been drained by the 1.2 microamps of current required by the voltage comparator. Consequently, for the purposes of this application, if the current drain caused by the voltage comparator is so small that it will not substantially reduce the ordinary shelf life of the battery, this current drain will be deemed negligible. However, when a signal is received by the signal receiver (50), the signal receiver (50) generates a small current which activates the voltage comparator (60). The voltage comparator (60) activates the output unit (70). This results in a sound output unit (12), ordinarily a piezoelectric buzzer and a light unit (13), ordinarily a light emitting diode being activated and powered by the battery (22). As will be explained below, there can be wide variations in the technologies employed to trigger signal receiver unit (50) to activate the voltage comparator (60) to power up the output unit (70), but until a signal is received by the signal receiver (50), the output unit (70) remains unpowered with no appreciable drain on the 3-volt battery (22). The servant receiver (10) should be activated by a signal from the master transmitter (200) (seen in FIG. 9) up to a distance of 50 feet of separation between the two. However, to make a master transmitter (200) producing radio frequency signals that can activate a servant receiver (10) without the servant receiver (10) requiring constant power, hence, battery drain, while at the same time meeting the appropriate FCC regulations is difficult.

Figure 5:
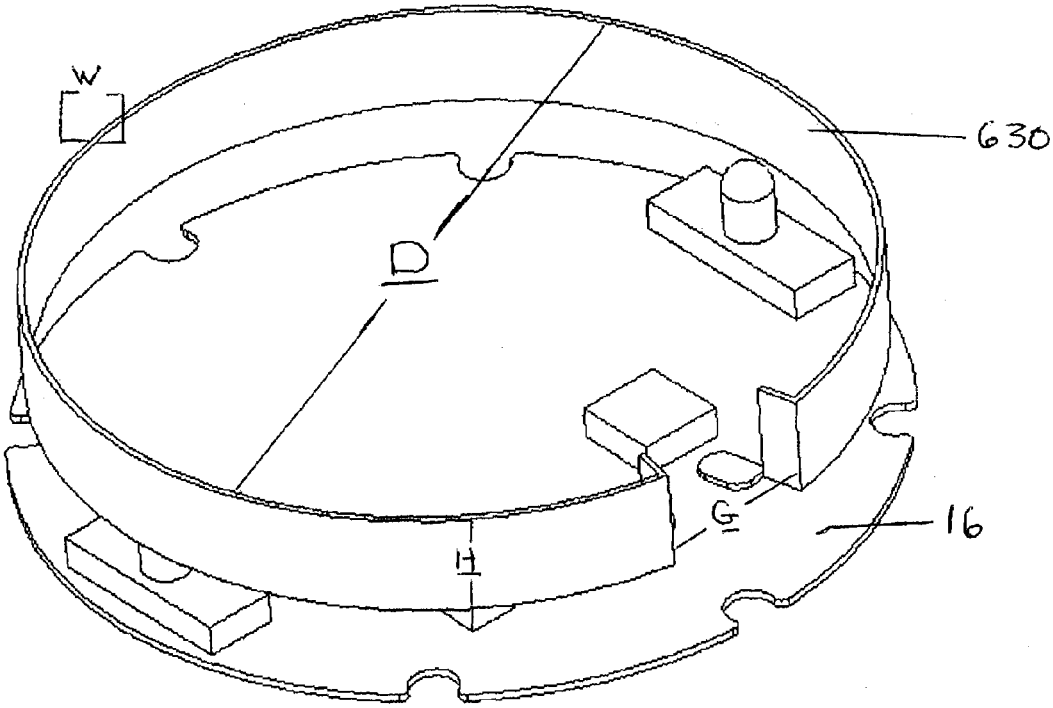
FIGS. 5 and 5A show a single radio frequency embodiment of the servant receiver with loop coil antenna requiring no amplification.
Figure 5A:
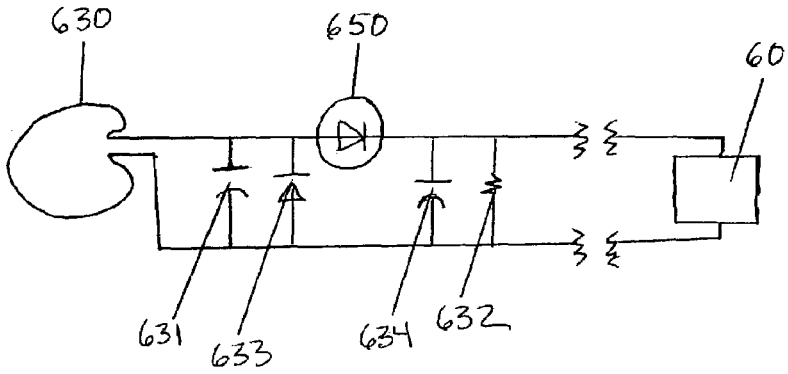

As shown in FIG. 5, a preferred embodiment uses a single radio frequency at 417.99 MHz. In FIG. 5 the antenna (630) is attached to the circuit board (16). The antenna (630) is tuned to this particular 417.99 MHz, although an antenna (630) could be designed to be tuned to another radio frequency. However, it is tuned to this particular narrow band for several reasons. First, 417.99 MHz is relatively free of common usage in the U.S. and Europe. This will reduce, if not eliminate, false triggerings by stray radio frequency signals in nearby radio frequency bands. At this frequency the transmitter may operate with enough power to trigger a response at 50 feet, while still remaining compliant with FCC Rule 47 C.F.R. Part 15, Section 15.231, for periodic operation. The antenna (630), when tuned to 417.99 MHz, is shaped like a loop and has a diameter (D) of 0.82 inches. It is 0.125 (⅛) inches high (H) and is constructed of thin metallic foil 0.008 inches in width (W). The metallic foil is preferably formed from copper (CU), nickel (Ni) or tin (Sn). The gap (G) of the loop antenna is from 0.08 to 0.1 inches. As shown in FIG. 5A for the antenna (630) described above, the detector diode (650) will be a zero bias Schottsky detector diode. For this particular circuit, an Agilent Technologies diode assigned part #HSMS-2852-BLK will serve. The capacitor (631) would be from 0.6 to 6 pico farads and the capacitor two (634) is 220 pico farads. The resistor (632) is 620 kilohms. FIG. 5A shows a simplified circuit diagram for the antenna (630). The antenna (630) will be matched with a detector diode (650) and voltage divider diode (633) with appropriate capacitors (631) and (634) and resistance (632). This design has a high ability to discriminate in responding to a particular frequency, hence, it is said to have a "high Q". The combination of the antenna (630) with the resistors (632), capacitors (631), and detector diode (650) result in the antenna (630) and ground plane (17) shown in FIGS. 8A, 8B, and 8C acting as the signal receiver unit (50). A 417.99 MHz low power radio signal compliant with FCC requirements is sufficient to cause the signal receiver unit (50) to generate a low-voltage signal, which is sent to the comparator (60). Particular micro-comparators that may be used in this application are the Texas Instruments comparator #TI TLV3702IDK (8 pin dual OPAMP low power rail-to-rail) or #TI TLV3701IDBV (5 pin single OPAMP low power rail-to-rail). These micro-comparators are sensitive below 0.1 millivolts. This particular signal receiver unit (50) design permits use of this Texas Instruments component at a very low sensitivity. This permits FCC compliance for signals from the master transmitter (200) while still permitting the servant receiver (10) to be triggered at 50 feet from the master transmitter (200) without any kind of active amplifying circuit in the servant receiver (10).

The dual radio frequency embodiment of this invention is designed to operate within the appropriate code of federal regulations governing radio, transmitters, and receivers. (See generally 47 Code of Federal Regulation, Part 15, Section 15.231). One way of accomplishing the above goal is to send out two simultaneous RF pulses. Under the appropriate FCC regulations, devices in this category can operate in a narrow frequency segment from 40.66 around 70 MHz with certain constraints as to the signal strength. In this embodiment the signal receiver (50) is an antenna circuit using a dual radio frequency tank circuit tuned to both 40.67 MHz and 77 MHz, which may use a surface mount zero bias Schottsky detector diodes. One such detector diode is manufactured and sold by Agilent Technologies and assigned part #HSMS-2852-BLK. This detector diode activates the voltage comparator (60) through an AND gate. Only when both frequencies are received simultaneously, they pass through the AND gate to continue to voltage comparator (60). The use of the dual frequencies with the AND gate will eliminate false triggering by nearby cell phones and other popular devices which may emit one of these frequencies but is unlikely to emit both simultaneously. Thus, only when the two frequencies are present simultaneously will the servant receiver (10) be triggered. This eliminates microprocessors or encoding/decoding in the circuit. The RF tank circuit embodiment of signal receiver unit (50) uses no amplification and there is no current drain when the servant receiver (10) is not operating. The voltage comparator (60) may use a very minor amount of current in the stand-by mode. One example of a voltage comparator (60) effective in this embodiment is made by Texas Instruments and assigned part #TI-TLV3702IIDGK. This particular voltage comparator (60) uses only 1.2 microamps in a stand-by mode. The master transmitter (200) uses standard pulsing technology to send pulsed signals at two to three-second intervals. Because the signal is pulsed, it provides an average radio frequency field strength at a value at 50 feet that meets the Federal Communication Commission's requirements. Moreover, the pulsing signal from the master transmitter (200) gives a pulsing tone and flashing light at the servant receiver (10). This makes the servant receiver (10) unit easier to find.

Figure 6:
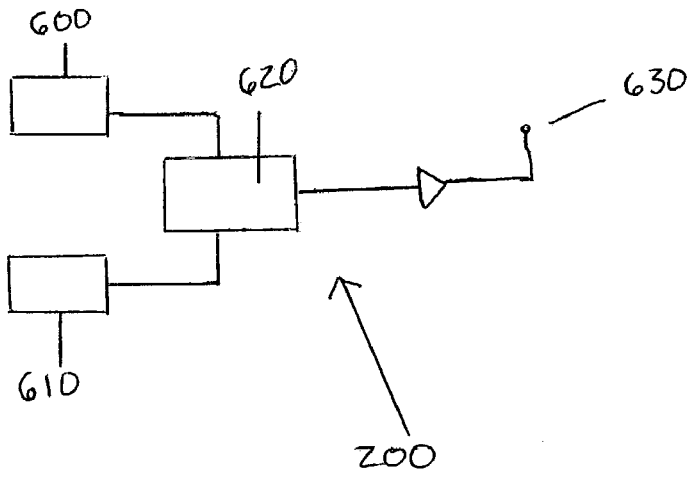
FIGS. 6 and 7 show frequency modulated embodiment of the master transmitter and servant receiver.
Figure 7:
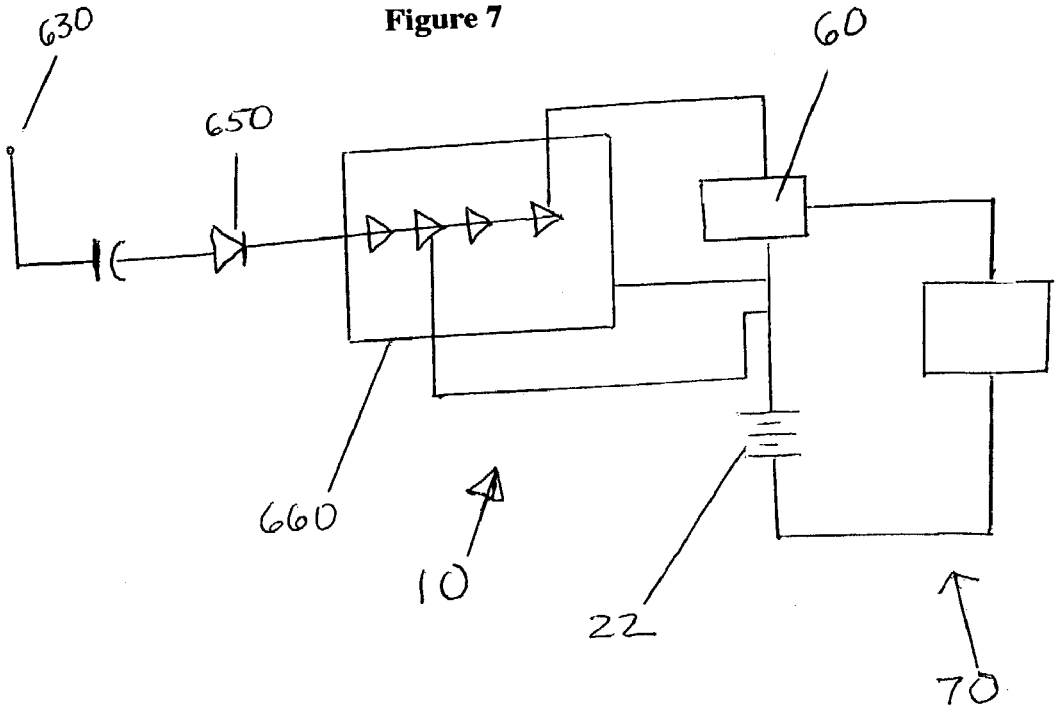

An alternate embodiment that uses radio frequency to trigger the servant receiver (10) requires that the master transmitter (200) use a single frequency active antenna circuit with a 918 MHz carrier frequency and a 4 KHz amplitude modulation. FIG. 6 is a simplified block diagram that shows the master transmitter (200) when there is a single frequency active antenna circuit with a 918 MHz carrier frequency and a 4 KHz amplitude modulation frequency. In the master transmitter (200) a 918 MHz oscillator (600) and a 4 KHz oscillator (610) will be combined in a signal combiner (620) to transmit a 918 MHz carrier signal with a 4 KHz amplitude modulation by the antenna (630). FIG. 7 shows a simplified circuit diagram for the servant receiver (10), which will have a single frequency active antenna (630) with an appropriate diode detector (650). Again, the Agilent Technologies HSMS-2852-BLK diode detector is used as part of the antenna detector circuit in the servant receiver (10). The 4 KHz amplitude modulation signal is filtered out in the servant receiver (10) circuit by a passive amplifier (660) that draws no current from the battery. As the 4 KHz amplitude modulation is filtered out, it is used to amplify the 918 MHz signal strength. Adding this passive amplifier (660) minimizes temperature drift in the detector diode (650) and increases signal strength. It also simplifies the servant receiver (10) because it removes the second frequency antenna circuit required in the dual radio frequency embodiment plus the AND gate. Again, the voltage comparator (60) is a Texas Instruments TI TLV3702IDGKR. This is an alternate way of solving the problem of sending enough radio frequency energy to trigger the servant receiver (10) while meeting the FCC requirements. Filtering out the AM portion of the 4 KHz tone and using it to gain signal strength in the signal receiver (50) removes the issue of pulsing or a low, duty cycle, as may be required on the dual frequency approach as described above.

Figure 8A:
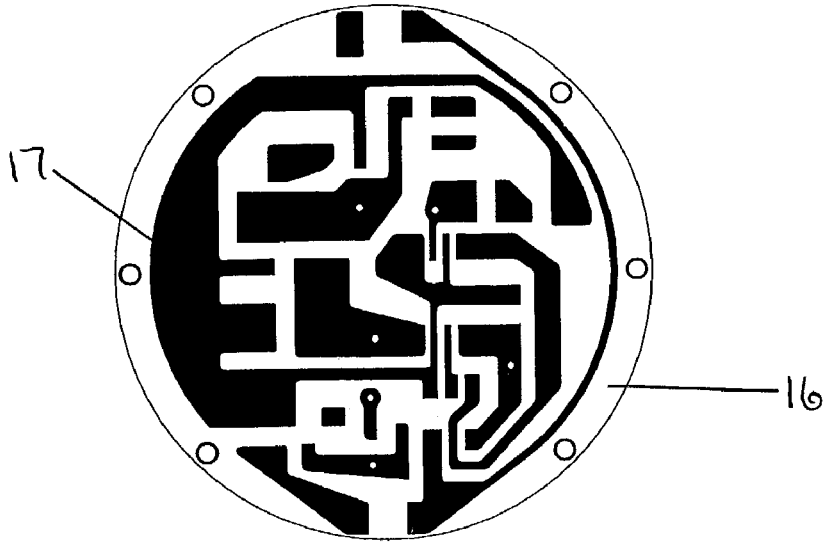
FIGS. 8A, 8B, and 8C show ground planes for the RF embodiment of the servant receiver.
Figure 8B:
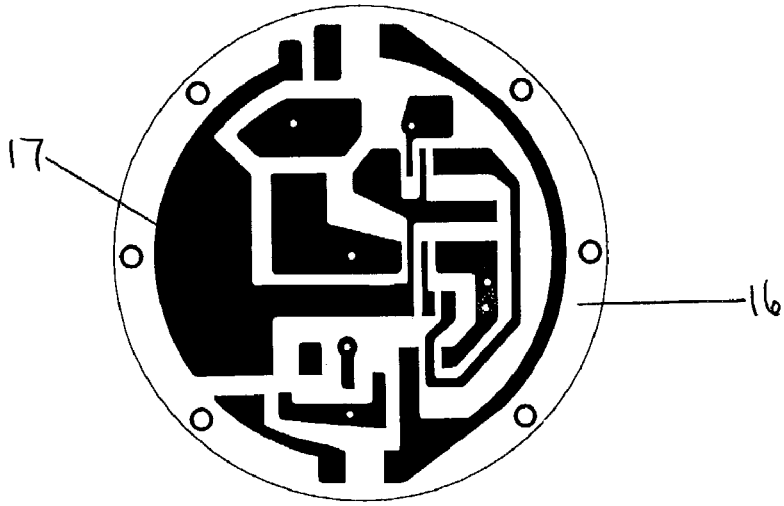
Figure 8C:
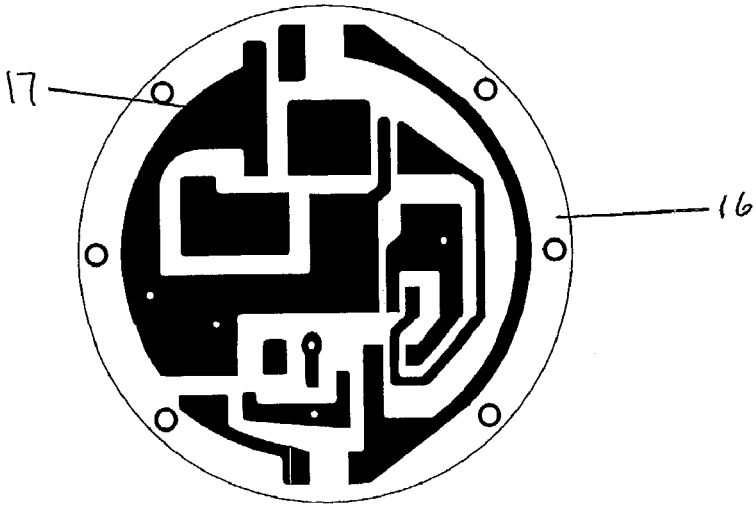

FIGS. 8A, 8B, and 8C show alternate embodiments of the copper ground plane (17) used on the printed circuit board (16) for the single frequency radio embodiment. The dark areas in the figures represent the actual copper ground plane (17) on the circuit board (16). FIG. 8A is used with the loop embodiment of the antenna (630), as shown in FIG. 5. When used with the Texas Instruments comparator #TI TLV3702IDGK (8 pin dual OPAMP low power rail-to-rail), the copper ground plane in FIG. 8A evidently acts in concert with the loop embodiment of the antenna (630) to increase the capacitance in the signal receiver unit (50) so when coupled with that particular voltage comparator (60) one achieves a high degree of signal sensitivity. When the signal sensitivity is at least 0.1 millivolts, this permits compliance with appropriate FCC regulations so that the radio signal generated by the master transmitter (200) is weak enough to comply for a non-licensed transmitter, while at the same time permitting reliable reception in the servant receiver (10) at 50 feet distance from the master transmitter (200). FIGS. 8B and 8C show alternate ground planes (17) for the loop embodiment of the antenna (630) which may be used either with the Texas Instruments comparator #TI TLV3702IDGK (8 pin dual OPAMP low power rail-to-rail) or the #TI TLV3701IDBV (5 pin single OPAMP low power rail-to-rail) comparator (60). FIGS. 8A, 8B, and 8C are not drawn to scale. The actual printed circuit boards (16) themselves are approximately one inch in diameter. These particular ground plane (17) designs 8A, 8B, or 8C would be coupled with the loop embodiment of the antenna (630) shown in FIG. 5 add capacitance to increase the Q of the signal receiver unit (10). When coupled with the appropriate comparator (60), it enables this design to achieve the desired design parameters of allowing the servant receiver (50) to be activated up to 50 feet away from the master transmitter (200) by compliant radio frequency signals generated by the master generator (200). However, this design requires no active amplification and consume negligible power from the battery (22) in the servant receiver (10) unless and until a radio frequency signal is received from the master transmitter (200).

A second technology may use an ultrasonic transducer. In the master transmitter unit (200) an appropriate frequency for an ultrasonic transducer in the master transmitter unit (200) is 40 KHz. When the master transmitter unit (200) is activated, it emits a steady ultrasonic pulse of 40 KHz. Here the signal receiver (50) is a piezoelectric transducer. Ordinarily, the ultrasonic signal emitted from the master transmitter unit (200) has a limited cone of angle of transmission. Usually, 15° cone angle of transmission is typical. The piezoelectric transducer in the servant receiver (10) will be activated when the 15° cone of transmission sweeps the location of the servant receiver unit (10). The piezoelectric transducer requires no amplification and no current drain. It will generate a small current sufficient to activate the voltage comparator (60) to again activate the batteries (22) to turn on the servant receiver unit (10) and to begin the sound output (12) and light unit (13) of the activated servant receiver unit (10). For ultrasonic pulses generated by the master transmitter (200), no FCC rules apply. The choice of an ultrasonic pulse at 40 KHz is to avoid disturbing pets or animals. Most cats or dogs can hear ultrasonic pulses up to around 20 KHz although, as with all animals, hearing diminishes in the upper ranges as the animal ages. Consequently, the transmitter power for the 40 KHz may be relatively high without concern over FCC regulations or concern for disturbing people or animals. The transmitter signal will be pulsed using standard pulsing technology. The purpose of this is to avoid timing circuits in the servant receiver (10) and also to preserve battery power since a pulsed sound output (12) and light unit (13) generated at the servant receiver (10) will require less power than a constant noise and light signal generated at the servant receiver (10). Again, there is no current drain present for the servant receiver (10) until it is activated by the signal from the master transmitter (200). In this design, no amplification is required and the servant receiver (10) is always awake. However, ultrasonic signals have drawbacks that are not present for radio frequency signals. They are more easily drown out by ambient noise and are more easily blocked by materials that intervene between the master transmitter (200) and the servant receiver (10). That is to say, radio frequency signals will penetrate a solid object that is between the servant receiver (10) and the master transmitter (200) more readily than will ultrasonic signals at appropriate power levels.

The third technology for signal generation from the servant receiver unit (10) is an infrared light emitting diode in the master transmitter unit (200). Here the signal receiver (50) is a comparable infrared detector. The IR detector at the servant receiver unit (10) will be activated by an infrared signal from the light emitting diode in the master transmitter unit (200). The IR detector does not require batteries and the IR signal generates a small electrical pulse which can be sensed by the voltage comparator (60) which again turns on the servant receiver unit (10) and activates the light unit (13) and sound output (12). The infrared signal does not require conforming the signal to FCC rules. A detector diode is used to receive a strong infrared signal to operate the voltage comparator (60). For an infrared signal, the range at which the servant receiver (10) may be activated may range to 100 feet. However, there must be clear line of sight between the master transmitter (200) and the servant receiver (10). This will limit the applications in some circumstances, but may be more desirable in others.

The use of an appropriately designed signal receiver unit (50) with appropriately matched comparator (60) in all embodiments permits the servant receiver (10) to be off until a signal is received from the master transmitter (200). No active amplifier circuit is required in any of the embodiments, no cycling of the servant receiver (10) from ON to OFF is required. There is no sleep mode in the servant receiver (10). Consequently, the effective life of the batteries in the servant receiver (10), if unused, is essentially the effective shelf life of the batteries. Removing sleep circuits, timing cycles, and no active amplification from this design for the servant receiver (10) greatly simplifies the design required for the servant receiver (10), which increases its reliability and durability.

Figure 9:
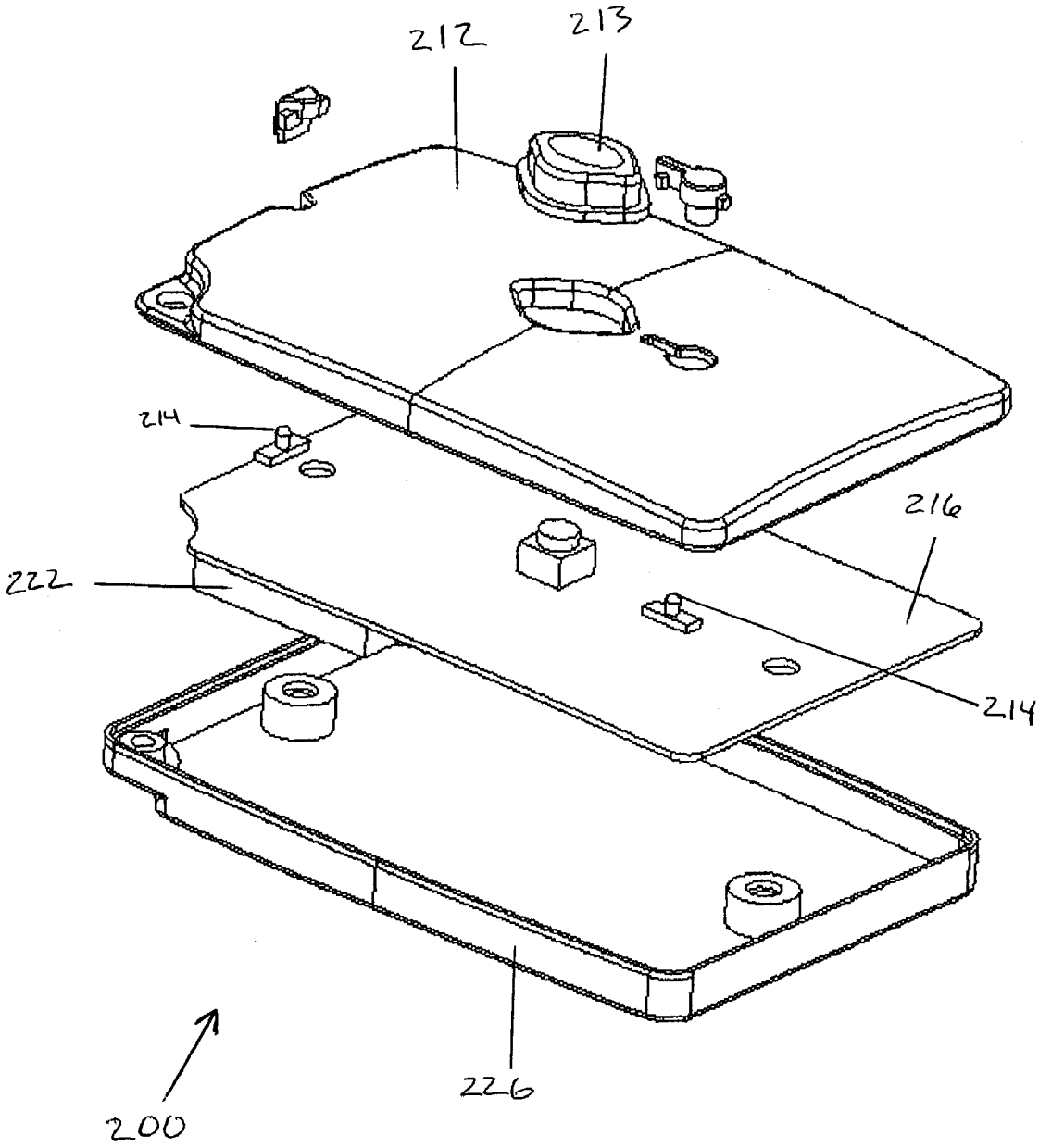
FIG. 9 is an exploded view of the master transmitter of the current invention.
Figure 10:
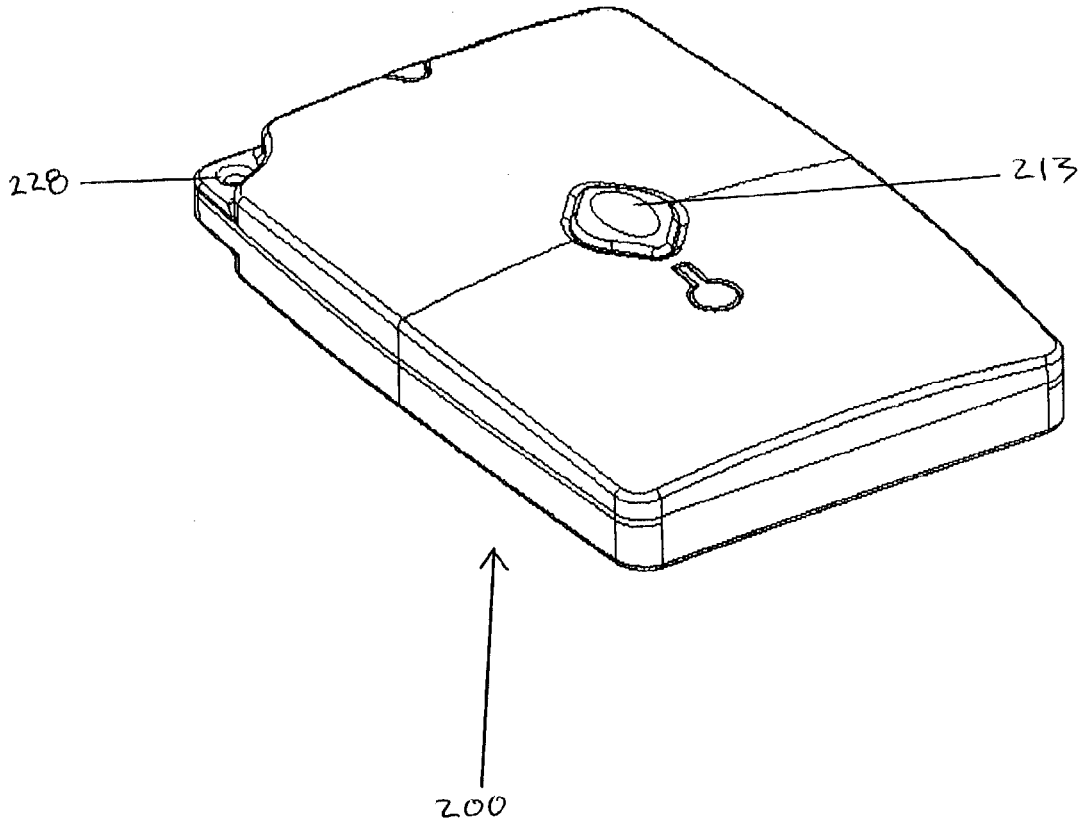
FIG. 10 is an assembled view of the master transmitter of the current invention.

FIG. 9 shows in an exploded view the master transmitter unit (200). There is a lower case (226) and a top (212). There is a transmitter key (213) which connects to the printed circuit board (216), which has a battery (222) that powers the operation of the printed circuit board (216). There are light-emitting diodes (214) on the printed circuit board (216) which light up when the transmitter key (213) activates the master transmitter (200). This tells the user that the battery (222) is effective and that an otherwise imperceptible signal is, in fact, being generated by the master transmitter (200). It is understood, other than was described in earlier figures regarding the dual frequency circuit, specifically FIG. 6, that the master transmitter (200)utilizes standard technologies, whether radio frequency, ultrasonic, or infrared signals. FIG. 10 shows the master transmitter (200) assembled with the transmitter key (213) in place. An attachment assembly (228) is viewed in FIG. 10. This is simply a bore in the rear of the master transmitter unit (200) for placement of attaching cord chain or the like. While the master transmitter unit (200) is a necessary part of the entire invention assembly, it is the servant receiver (10) and its ability to remain off so that the energy generated signal sent by the master transmitter (200) is sufficient to activate the servant receiver (10) that is most important. This enables the servant receiver (10) to operate without an appreciable drain on any batteries until the light unit (13) and sound output (12) are actually activated by a signal generated by the master transmitter unit (200). It will be appreciated by one of skill in the art that standard features of this invention can be varied without departing from the spirit of the invention, which is limited not by the foregoing description of preferred embodiments, but rather by the claims which follow.

I claim:

1. An apparatus for locating an object comprising:

(a) a master transmitter unit with a means for transmitting a signal and a means for controlling said means for transmitting;

(b) at least one servant receiver having (1) an output unit, said output unit having means for attracting a user's attention and a servant output battery for powering said output unit; (2) a comparator unit operatively connected to said output unit whereby said comparator unit activates said output unit powered by said servant output battery, said comparator unit drawing negligible current from said servant output battery; and (3) a signal receiver unit for receipt of said signal generated by said transmitter unit, said signal from said master transmitter unit generating a current in said signal receiver unit thereby activating said comparator unit to activate said servant output battery to power said output unit;

whereby said at least one servant receiver uses negligible current from said servant output battery until activated by a signal from said master transmitter unit, so that the effective life of said servant output battery in said servant unit, if said servant unit is unused, is approximately the same as the life of said servant output battery;

wherein said comparator unit is matched to said signal receiver unit to achieve a sensitivity of at least 0.1 millivolts.

2. An apparatus for locating an object of claim 1 wherein said means for transmitting a signal is a radio frequency transmitter.

3. An apparatus for locating an object of claim 2 wherein said radio frequency transmitter generates a single definite radio frequency.

4. An apparatus for locating an object of claim 3 wherein said signal receiver unit further includes an antenna of a definite shape and a ground plane of a definite shape resulting in said signal receiver unit having a high Q for said definite radio frequency.

5. An apparatus for locating an object of claim 4 wherein said definite radio frequency is greater than 416 MHz but less that 420 MHz.

6. An apparatus for locating an object of claim 5 wherein said signal receiver unit wherein said antenna of a definite shape is a loop antenna with a diameter of approximately 0.82 inches, a height of approximately 0.125 inches, and a width of approximately 0.008 inches, with a gap in said loop antenna of approximately between 0.08 to 0.1 inches.

7. An apparatus for locating an object of claim 6 wherein said loop antenna in said signal receiver unit is operatively connected to a circuit of a definite design.

8. An apparatus for locating an object of claim 7 wherein said negligible current used by said comparator unit is less than two microamps.

9. An apparatus for locating an object of claim 2 wherein said radio frequency transmitter generates a first definite radio frequency and a second definite radio frequency.

10. An apparatus for locating an object of claim 9 wherein said signal receiver unit includes an AND gate whereby said comparator is activated only when said first definite radio frequency and said second definite radio frequency are simultaneously received by said signal receiver unit.

11. An apparatus for locating an object of claim 10 wherein said master transmitter unit further comprises means for pulsing said radio frequency transmitter.

12. An apparatus for locating an object of claim 11 wherein said negligible current used by said comparator unit is less than 2 microamps.

13. An apparatus for locating an object of claim 2 wherein said radio frequency transmitter generates a single definite radio frequency with an amplitude modulation.

14. An apparatus for locating an object of claim 13 wherein said signal receiver unit contains a passive amplifier that uses said amplitude modulation in said single definite signal to strengthen said single definite radio frequency signal strength.

15. An apparatus for locating an object of claim 14 wherein said negligible current used by said comparator unit is less than 2 microamps.

16. The apparatus for locating an object of claim 4 wherein said definite radio frequency is greater than 500 KHz but less that 1600 MHz.

17. An apparatus for locating an object of claim 1 wherein said means for transmitting a signal is an ultrasonic transducer and said signal receiver unit is a piezoelectric transducer.

18. An apparatus for locating an object of claim 17 wherein said master transmitter unit emits an ultrasonic signal with a limited angle of transmission.

19. An apparatus for locating an object of claim 8 wherein said limited angle of transmission is approximately 15°.

20. An apparatus for locating an object of claim 19 wherein said master transmitter unit further contains means for pulsing said ultrasonic transmission.

21. An apparatus for locating an object of claim 20 wherein said ultrasonic signal is approximately 40 KHz.

22. An apparatus for locating an object of claim 21 wherein said negligible current used by said comparator unit is less than 2 microamps.

23. An apparatus for locating an object of claim 1 wherein said means for transmitting a signal is an infrared light-emitting diode and said signal receiver unit contains an infrared detector.

24. An apparatus for locating an object of claim 23 wherein said infrared light-emitting diode generates a signal strong enough to be received by said servant receiver at a range of at least 100 feet.

25. An apparatus for locating an object of claim 24 wherein said negligible current used by said comparator unit is less than 2 microamps.

26. The apparatus for locating an object of claim 1, wherein said comparator unit consists of exactly one comparator.

* * * * *